United States Patent [19]

Behne et al.

[11] Patent Number: 4,750,668

[45] Date of Patent: Jun. 14, 1988

[54] MULTIPLE PRODUCT WRAPPING SHEET

[75] Inventors: James A. Behne; Henry M. Chewning, III, both of Henrico County, Va.

[73] Assignee: Reynolds Metals Company, Richmond, Va.

[21] Appl. No.: 23,754

[22] Filed: Mar. 9, 1987

[51] Int. Cl.[4] ..... B65D 65/10; B65D 65/22

[52] U.S. Cl. ..... 229/87 F; 206/459; 229/DIG. 13

[58] Field of Search ..... 229/87 F, DIG. 13; 206/459; 40/360

[56] References Cited

U.S. PATENT DOCUMENTS

| | | | |
|---|---|---|---|
| 1,661,479 | 3/1928 | Josephson | 229/87 F |
| 1,694,701 | 12/1928 | Corel | 229/87 R |
| 1,933,793 | 11/1933 | Douglas | 229/87 F |
| 2,084,026 | 6/1937 | Gurwick | 229/87 F |
| 2,115,318 | 4/1938 | Rosen | 229/87 B |
| 2,155,057 | 4/1939 | Moore | 206/459 |
| 2,225,694 | 12/1940 | Freeman | 229/87 F |
| 2,723,643 | 11/1955 | Weiss | 116/133 |
| 2,865,769 | 12/1958 | Jacke | 229/87 F |
| 2,893,876 | 7/1959 | Murphy | 99/171 |
| 3,096,014 | 7/1963 | Swan | 229/87 B |
| 3,857,139 | 12/1974 | Turner | 24/30.5 T |
| 3,974,916 | 8/1976 | Bartolucci | 206/459 |
| 4,630,733 | 12/1986 | Fear | 206/459 |

*Primary Examiner*—Stephen P. Garbe
*Attorney, Agent, or Firm*—Alan T. McDonald

[57] ABSTRACT

A wrapping sheet material for multiple products, such as related fast food items, is disclosed. The wrapping sheet material of the present invention permits up to four separate items to be wrapped with the same wrapping sheet material while maintaining identification of the individual products.

10 Claims, 10 Drawing Sheets

MULTIPLE PRODUCT WRAPPING SHEET

BACKGROUND OF THE INVENTION

Wrapping sheets for products such as fast food items, and especially related fast food items such as sandwiches, burritos, tacos and the like, are commonly employed. Most commonly, sheet material wrappers formed of paper, aluminum foil and aluminum foil-paper laminates are employed.

Such wrapping sheets are normally printed on the exposed surface when enclosing a product to identify the product contained therein. This may be accomplished by color coding, pictures, wording or a combination of these.

Being both space and cost conscious, the fast food operation with an ever-increasing proliferation of products is unhappy with individual wrapping sheets for each product. Such fast food operators, therefore, desire wrapping sheets which may be used to contain one of several products, while at the same time allowing both the fast food operation's personnel and the consumer the ability to identify the product within the wrapping sheet.

One proposal for such a wrapping sheet is found in U.S. Pat. No. 2,893,876. In this patent, the sheet is printed with indicia for the various products that may be contained within the sheet. The store personnel, after wrapping, pierces the area of indicia relating to the product contained with a toothpick. This required additional material is not compatible with the storage and cost considerations of many fast food outlets.

It has also been proposed to provide wrapping materials in which a different product identification is printed in each of the four corners of the generally rectangular wrapping sheet. In this system, the product is wrapped diagonally, such that the loose corner resulting from the wrapping operation bears the indicia of the product wrapped therein. While such a wrapping sheet provides the necessary identification function, such sheets must be produced to fine registration tolerances in the printing and cutting operations in order that the indicia is provided in the proper locations on each sheet. This increases the cost of the manufacture and thus the cost of the wrapping sheet to the fast food outlet.

There remains a need, therefore, for a wrapping sheet material which allows for multiple product identification and which does not require registration during printing, thus reducing its cost to the purchaser.

It is thus the primary objective of the present invention to produce a wrapping material for multiple products which allows for ease of identification of the product contained while at the same time not requiring registration during production of the wrap.

THE PRESENT INVENTION

By means of the present invention, this desired objective has been obtained. The wrapping sheet of the present invention has four generally parallel, longitudinal regions of indicia provided on both the inner and outer surfaces thereof. The two central regions of indicia for both the inner and outer surfaces have product indicia printed generally crosswise to the length of the wrap and facing in opposite directions from each other, with corresponding indicia regions of the inner and outer surfaces being directly above and below one another. The two outer regions have their indicia printed generally longitudinally to the wrapping sheet. However, the indicia of these regions are inverted between the inner and outer surfaces.

The orientations of the indicia of both the inner and outer surfaces permit the fast food outlet worker to wrap any of the identified contents within the wrapping sheet such that the identification for the contained product appears on the top surface after wrapping, permitting easy identification of the contained product.

Due to the repetitive nature of the indicia printing, there is no need for control to assure that individual sheets are printed and cut in registry. This permits wider latitude in printing and cutting, thus reducing substantially the cost of the produced product.

BRIEF DESCRIPTION OF THE DRAWINGS

The wrapping sheet material of the present invention will be more fully described with reference to the FIGURES in which.

DETAILED DESCRIPTION OF THE PREFERRED EMBODIMENTS

Figure 1:
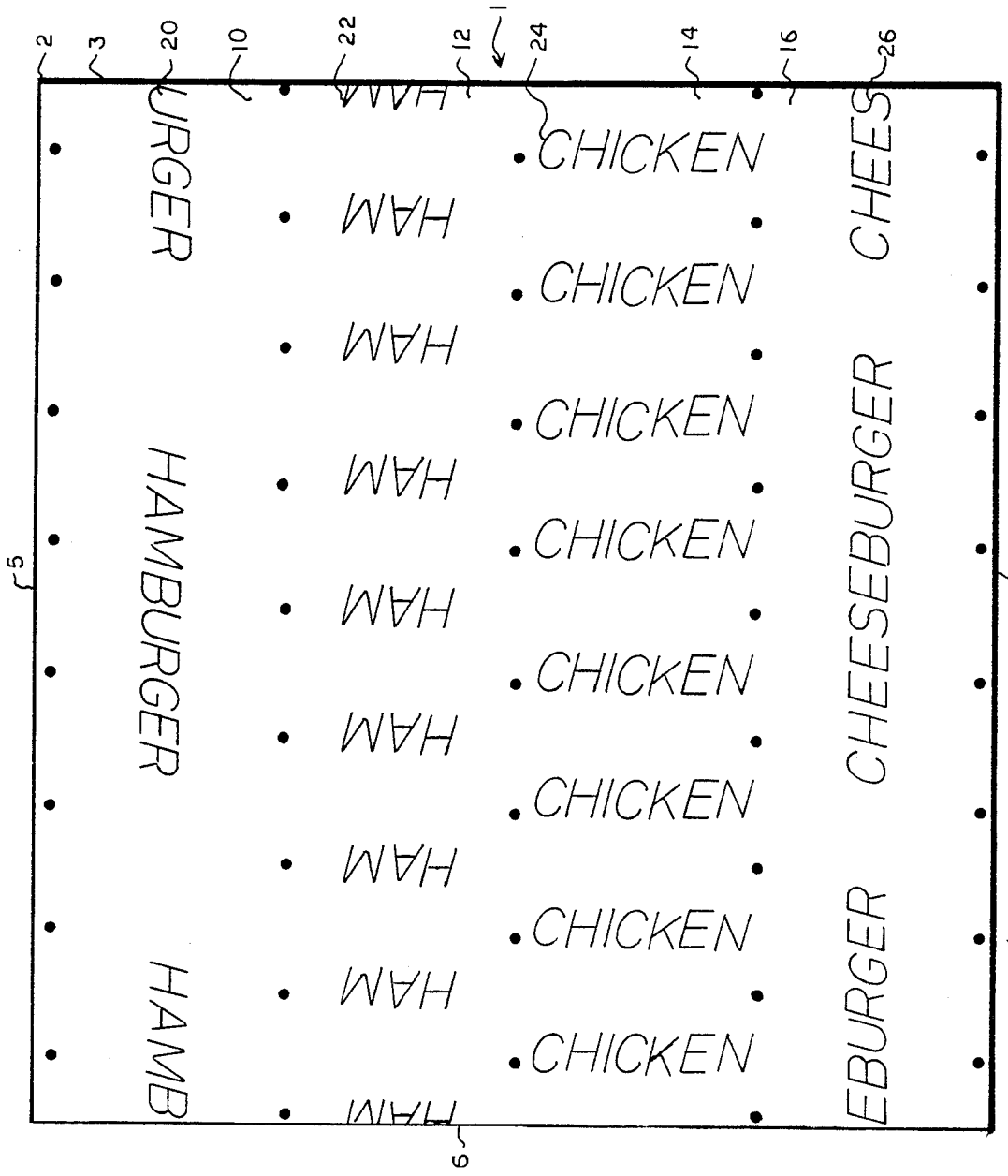
FIG. 1 is a top elevational view of the wrapping sheet of the present invention, showing what will be the outer surface of the sheet when the product has been wrapped therein.
Figure 2:
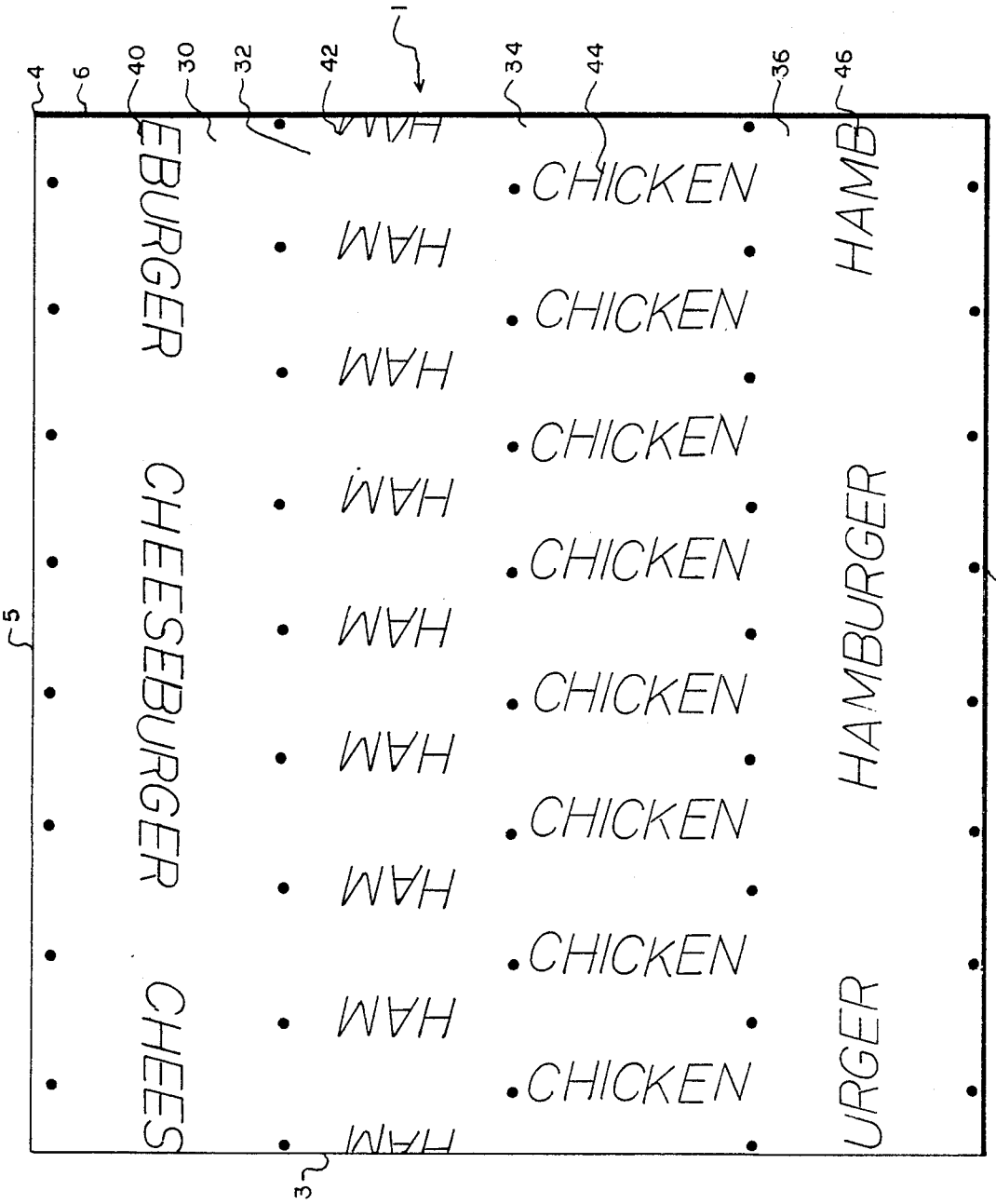
FIG. 2 is a top elevational view of the wrapping sheet of the present invention, illustrating what will be the inner surface of the sheet after wrapping of the product therein.
Figure 3:
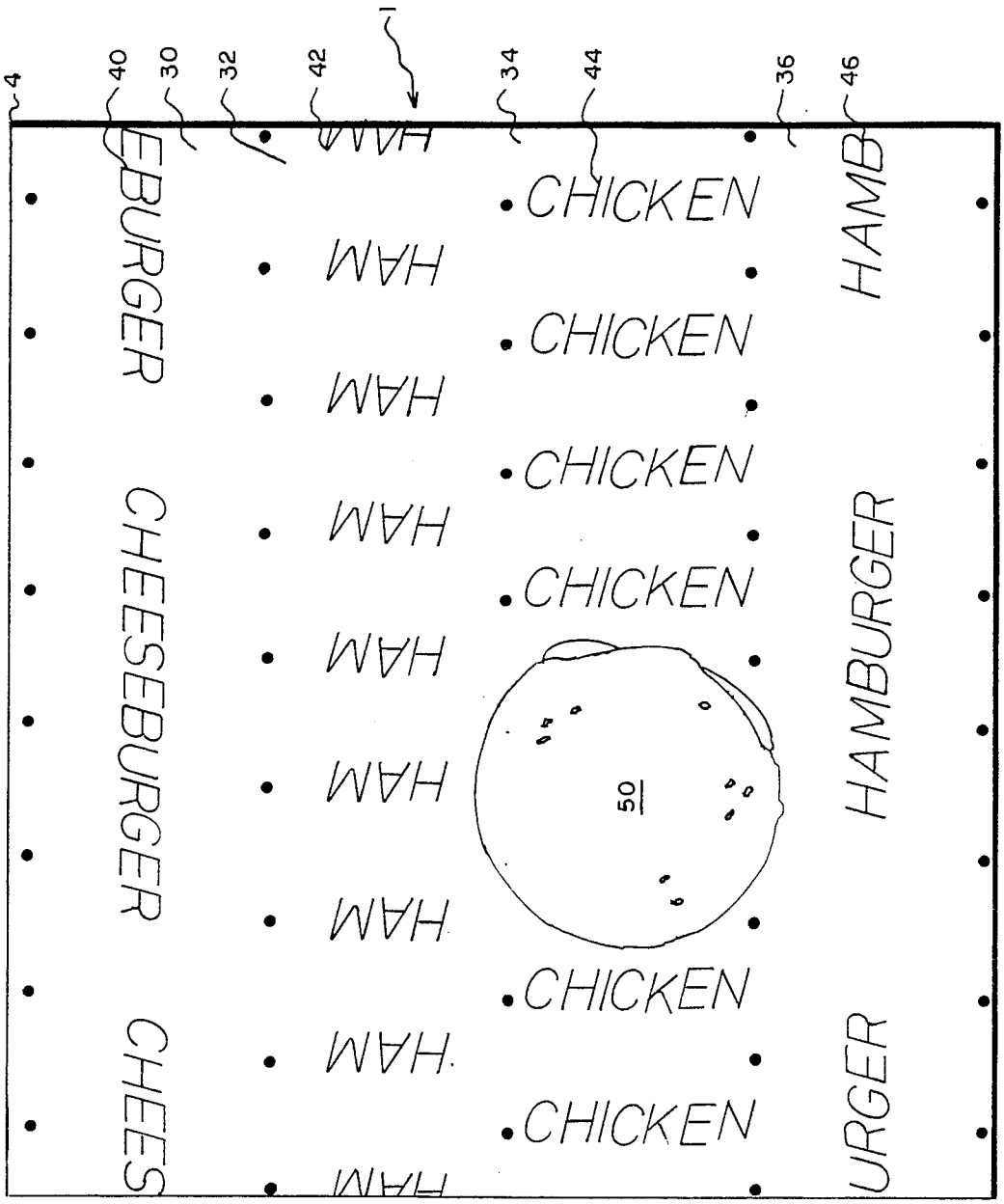
FIG. 3 is a top elevational view illustrating the positioning of a product on the inner surface of the wrapping sheet for wrapping therein.

Turning now to the FIGURES, and especially to FIGS. 1 and 2, the wrapping sheet 1 of the present invention is illustrated. This wrapping sheet 1 may be generally rectangular or square, depending upon the nature of the products being wrapped therein, and may vary in size, again based upon the types of products being wrapped therein. The wrapping sheet 1 may be formed of any of the typical wrapping materials employed for such purposes, such as, for example, aluminum foil, paper and aluminum foil-paper laminates. The wrapping sheet 1 has a surface 2, illustrated in FIG. 1, and a surface 4, illustrated in FIG. 2. For purposes of further identification, surface 2 is defined as the outer surface which will be exposed and seen after the product has been wrapped in the wrapping sheet 1 and surface 4 is defined as the inner surface in contact with the product. The wrapping sheet 1 has end edges 3 and 6 and side edges 5 and 7.

Looking more particularly at the outer surface 2, surface 2 has four generally longitudinal and generally parallel indicia bearing regions. The two outer indicia bearing regions 10 and 16 bear indicia 20 and 26 respectively. The indicia 20 and 26 are repeating, and are printed generally in the longitudinal direction of the wrapping sheet 1. As illustrated, indicia 20 and 26 are shown as facing their respective edges 5 and 7. While such an orientation of indicia 20 and 26 is preferred, it is not necessary for the proper operation of the wrapping sheet 1, as will be shown below.

The two central indicia bearing regions 12 and 14 carry indicia 22 and 24 respectively. The indicia 22 and 24 are also repeating. They are oriented generally crosswise to the longitudinal direction of the wrapping sheet 1 and oriented towards opposing edges of the sheet 1. Thus, indicia 24 faces edge 6, while indicia 22 faces edge 3.

FIG. 2 illustrates the inside surface 4 of the wrapping sheet 1. In this FIGURE, wrapping sheet 1 has been turned over by lifting edge 3 of FIG. 1 and turning the wrapping sheet 1 over such that edges 3 and 6 have been inverted.

In this FIGURE, it is seen that the wrapping sheet 1 is again divided into four regions of indicia lying generally parallel and generally longitudinally with the wrapping sheet 1. On surface 4, the outer indicia regions 30 and 36 bear indicia 40 and 46 respectively and central indicia carrying regions 32 and 34 bear indicia 42 and 44 respectively. Between the outer surface 2 and inner surface 4, indicia bearing regions 10 and 30, 12 and 32, 14 and 34, and 16 and 36 lie directly above and below one another.

The central indicia bearing regions 32 and 34 of surface 4 carry the same identifying indicia as their corresponding regions 12 and 14 of outer surface 2. Again, the indicia of central regions 32 and 34 are oriented generally crosswise to the longitudinal direction of wrapping sheet 1 and bear repeating indicia of the product to be identified by the region. On surface 4, however, indicia 42 faces edge 6 and indicia 44 faces edge 3, which is the opposite of outer surface 2, for purposes that will be more fully explained below.

The indicia 40 and 46 of outer regions 30 and 36 do not identify the same product as indicia 20 and 26 of corresponding regions 10 and 16. Rather, these product identifications have been inverted such that indicia 40 of region 30 identifies the same product as indicia 26 of region 16 and indicia 46 of region 36 identifies the same product as indicia 20 of region 10. The reason for this orientation of indicia will be discussed more fully below when explaining the wrapping of a product within wrapping sheet 1.

FIGS. 3 through 7 illustrate the wrapping of a product 50 within wrapping sheet 1 when the product 50 identified by the indicia of one of the central regions. In the case illustrated, product 50 is identified by the indicia 44 of region 34 and indicia 24 of region 14.

So that the operator wraps the products consistently, it is desired that the operator orient the wrapping sheet 1 such that the product to be wrapped has its indicia facing the operator. Thus, when wrapping according FIGS. 3 through 7, an operator would have rotated wrapping sheet 1 90 degrees counterclockwise. Had the article to be wrapped been that of region 32, the operator would have rotated wrapping sheet 1 90 degrees clockwise. Had the article to be wrapped been that of region 30 the operator would have rotated the wrapping sheet 1 180 degrees and had the article to be wrapped been that of region 36 wrapping would have occurred as wrapping sheet 1 is oriented in FIG. 3. The article 50 is then placed over region 34 corresponding to the product identification of indicia 44 relating to product 50.

Figure 4:
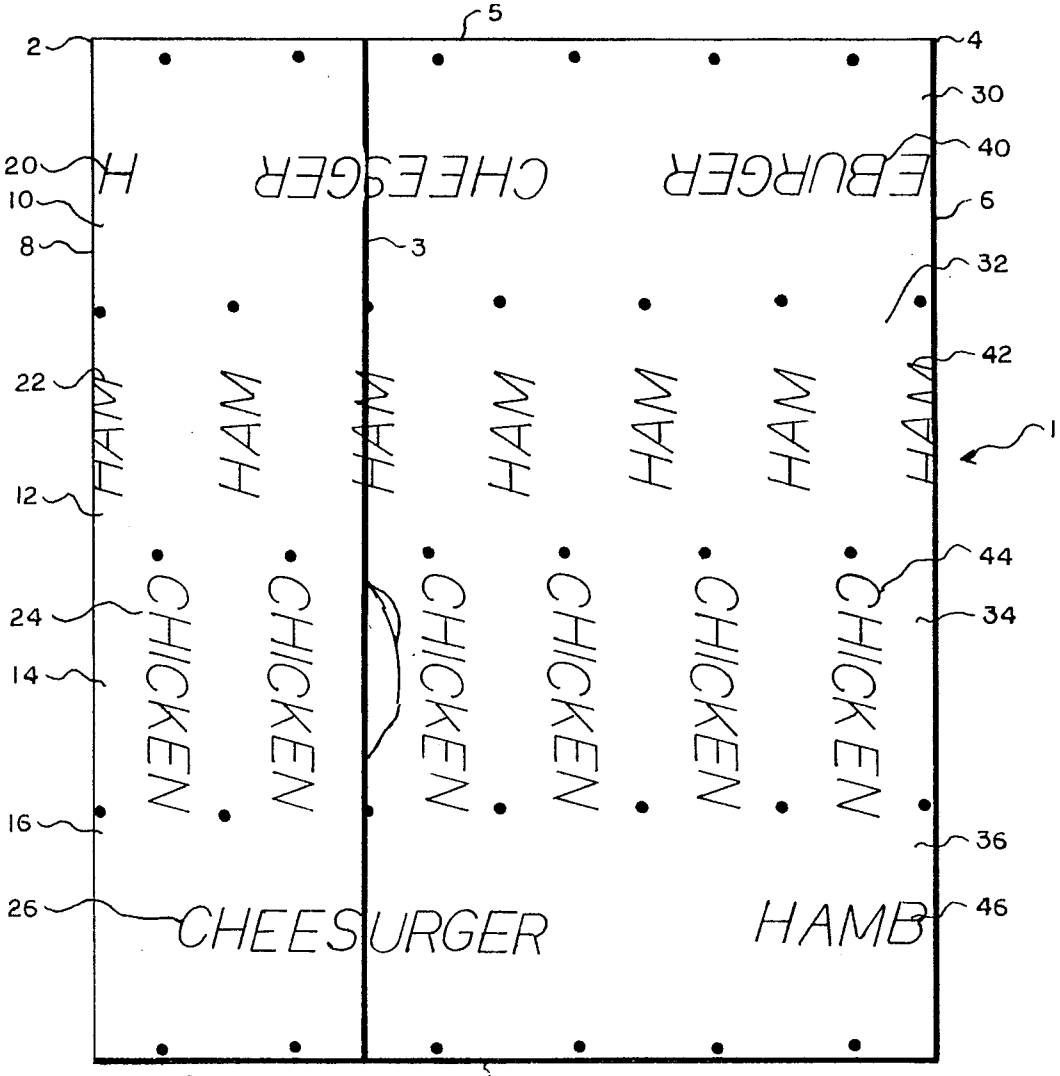
FIG. 4 is a top elevational view illustrating the first step in wrapping a product within the wrapping sheet of the present invention.

In FIG. 4, the first wrapping step has taken place. Edge 3 has been pulled over product 50 such that a portion of outer surface 2 now having an outer edge 8 is now exposed.

At this point, it can be seen that when edge 3 is folded over surface 4, the indicia 22 and 42 of regions 12 and 32 are oriented in the same direction generally crosswise to the longitudinal direction of the wrapping sheet 1 and that the indicia 24 and 44 of regions 14 and 34 are oriented in the same generally crosswise direction to the longitudinal direction of wrapping sheet 1. Also, it can now be seen that the indicia 26 of region 16 is the opposite to that of indicia 46 of region 36 and that indicia 20 of region 10 is the opposite to that of indicia 40 of region 30, such that indicia 40 of region 30 and indicia 26 of region 16 correspond to one another and such that indicia 20 of region 10 and indicia 46 of region 36 correspond to one another.

Figure 5:
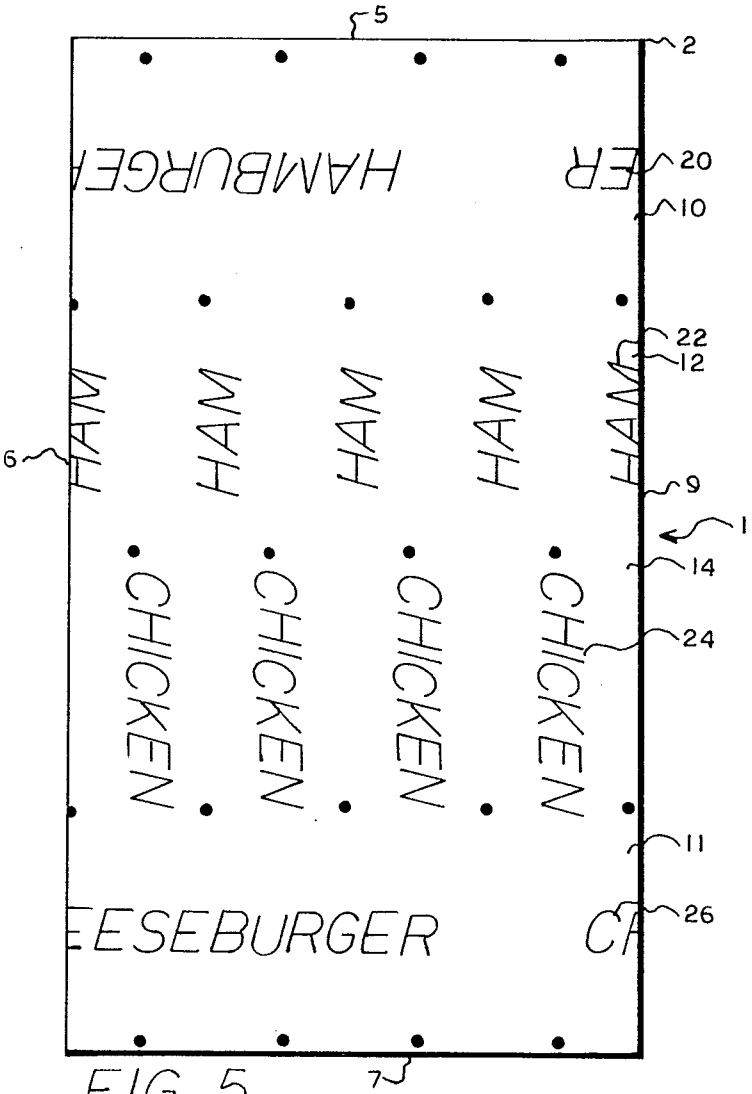
FIG. 5 is a top elevational view illustrating the second step in wrapping a product within the wrapping sheet of the present invention.

In FIG. 5, edge 6 has been folded over product 50 to approximately edge 8, creating edge 9. At this point, the entire inner surface 4 is no longer visible.

Figure 6:
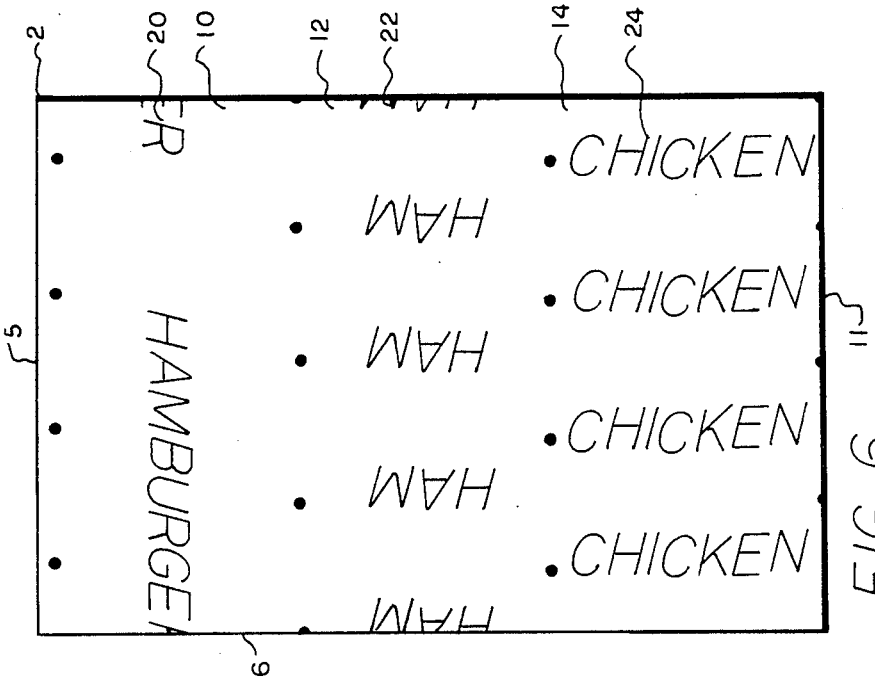
FIG. 6 is a top elevational view illustrating the third step in wrapping a product within the wrapping sheet of the present invention.

In FIG. 6, the excess portion of wrapping sheet 1 from edge 7 has been folded under product 50, creating edge 11.

Figure 7:
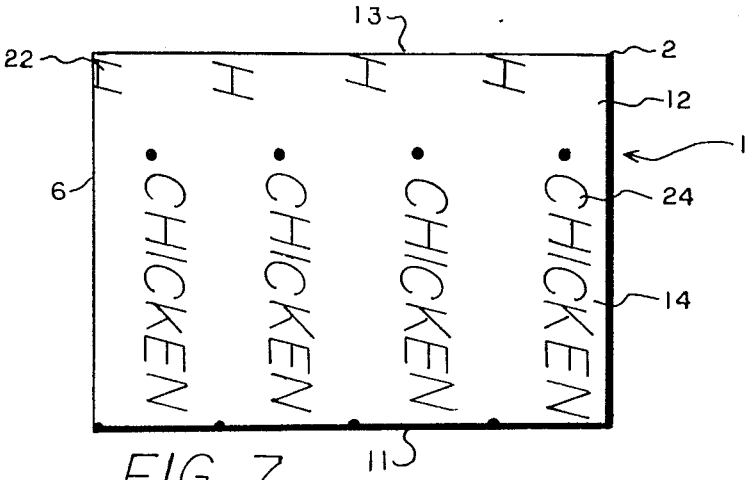
FIG. 7 is a top elevational view illustrating the completed wrapping of a product within the wrapping sheet of the present invention.

In FIG. 7, the wrapping operation has been completed by folding the excess portion of wrapping sheet 1 from edge 5 under product 50, creating edge 13. As can be readily seen, the product indicia 24 of region 14 readily identifies the product 50 within wrapping sheet 1.

The same series of wrapping operations, and the obvious changes in the identification of the edge numbers to be folded in each step resulting from the rotation of the wrapping sheet 1 would take place if the product were identified by indicia 42, with the only exception being the rotation of wrapping sheet 1 such that indicia 42 faces the operator to commence the wrapping operation.

To wrap a product bearing the indicia of either regions 30 or 36, a slight modification of the wrapping sequence occurs. When the appropriate indicia has been oriented to face the operator, rather than positioning the article over the indicia of the appropriate region, the operator places the product in the region above the region of the appropriate indicia, with the same wrapping sequence then occurring, again with the obvious changes in the identification of the edge numbers to be folded in each step resulting from the rotation of the wrapping sheet 1, resulting in the appropriate indicia on top of the package when wrapping has been completed.

Figure 8:
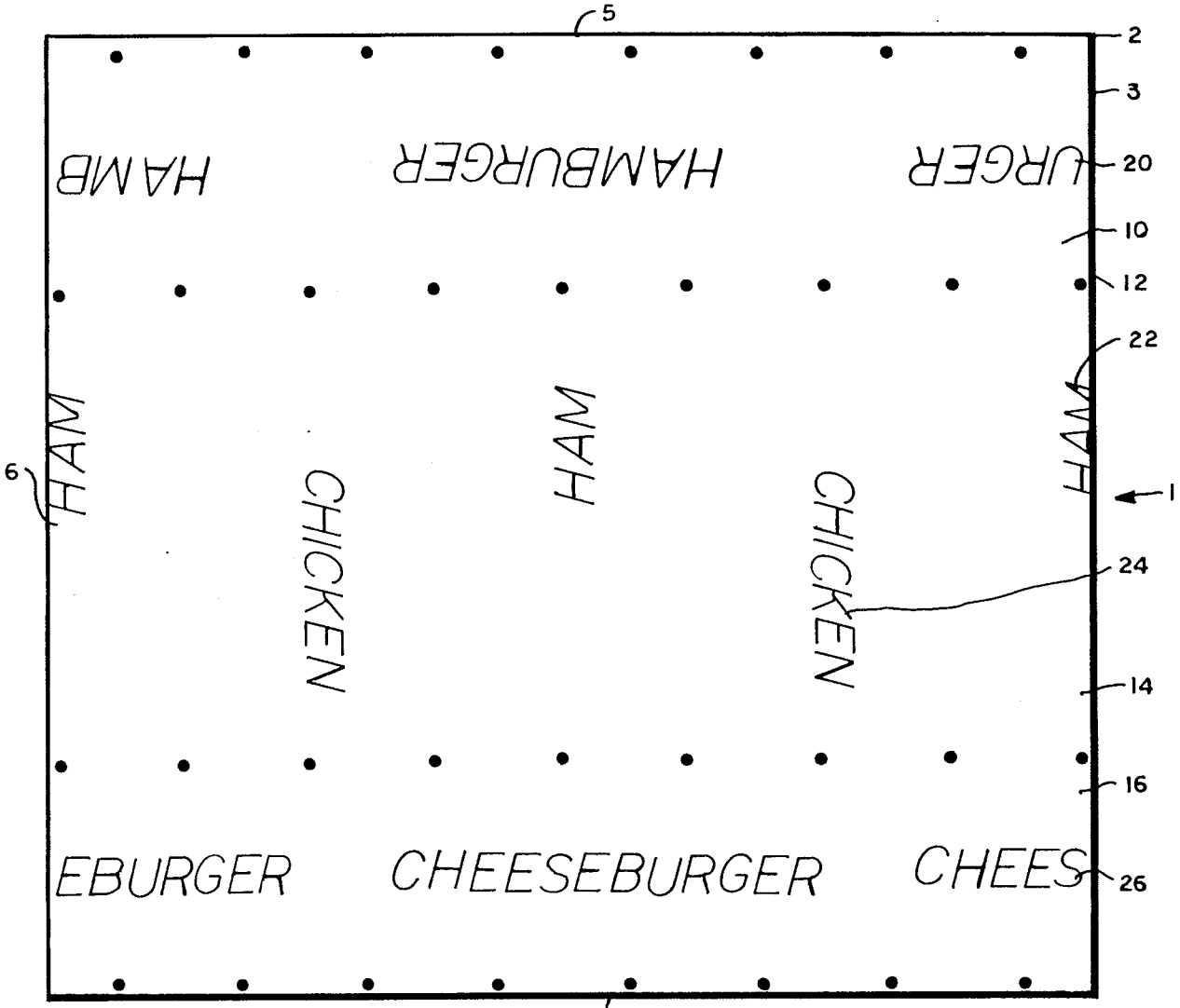
FIG. 8 is a top elevational view of the wrapping sheet of the present invention, showing partial overlap of the second and third regions of the sheet.
Figure 9:
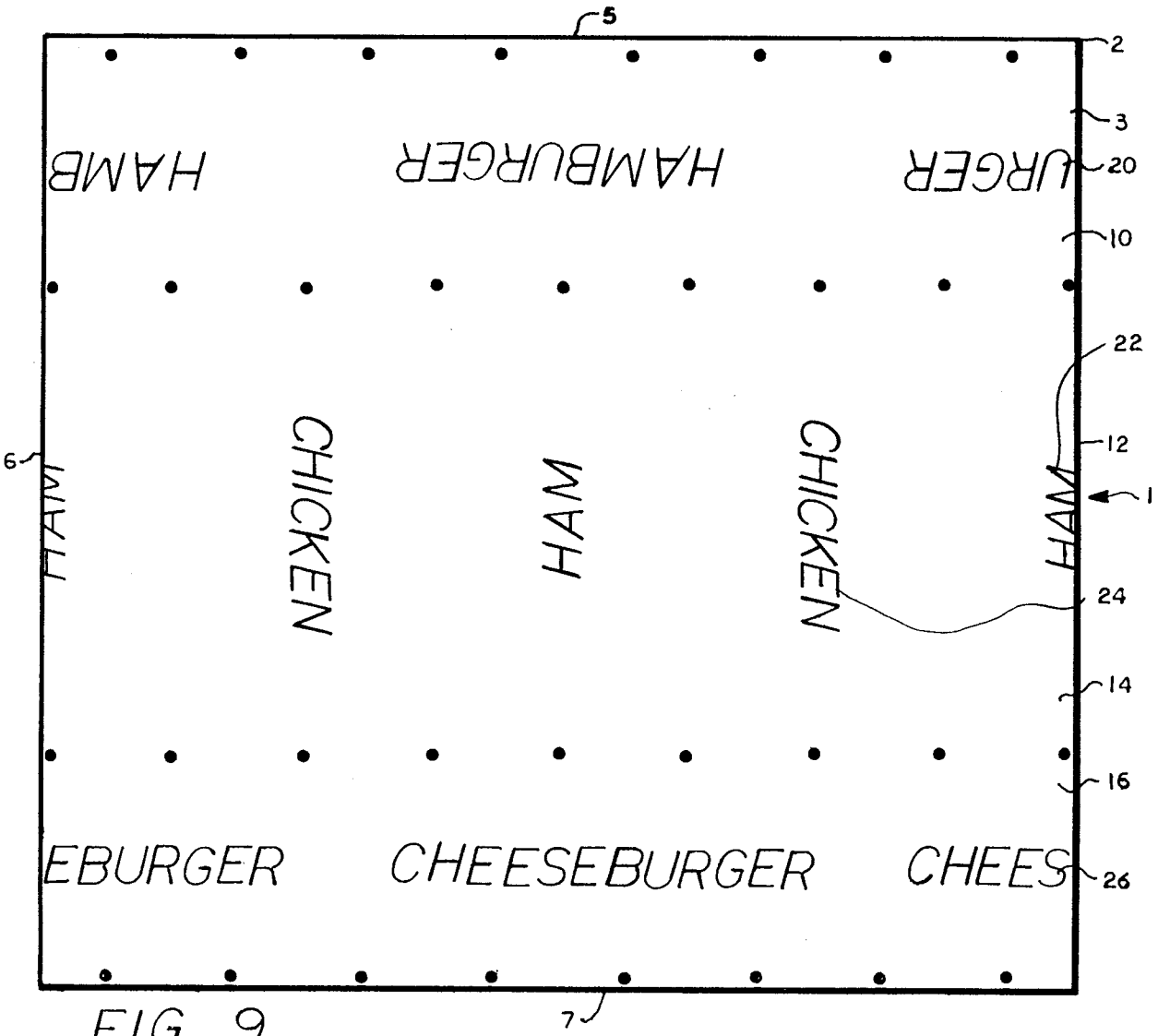
FIG. 9 is a top elevational view of the wrapping sheet of the present invention, showing complete overlap of the second and third regions of the sheet.

While the FIGURES illustrate regions 12 and 14 and corresponding regions 32 and 34 as completely separated, these regions could partially or totally overlap, as illustrated in FIGS. 8 and 9 respectively. If overlapping is permitted, identification of the product contained within the wrapping sheet 1 is based upon the indicia which faces the loose top edge portion, 3 or 6, as shown in FIG. 7, which is created when wrapping is completed.

As can be seen from the FIGURES, upon completion of wrapping, the identifying indicia is readily seen on the top surface of the completed package. While in certain circumstances this indicia will not necessarily be centered or the only indicia visible, it will be readable and clearly identifiable. Thus, it is clear that individual wrapping sheets 1 need not have identically positioned indicia in each of the regions thereof, thus eliminating the need for registered printing of wrapping sheets 1.

Figure 10:
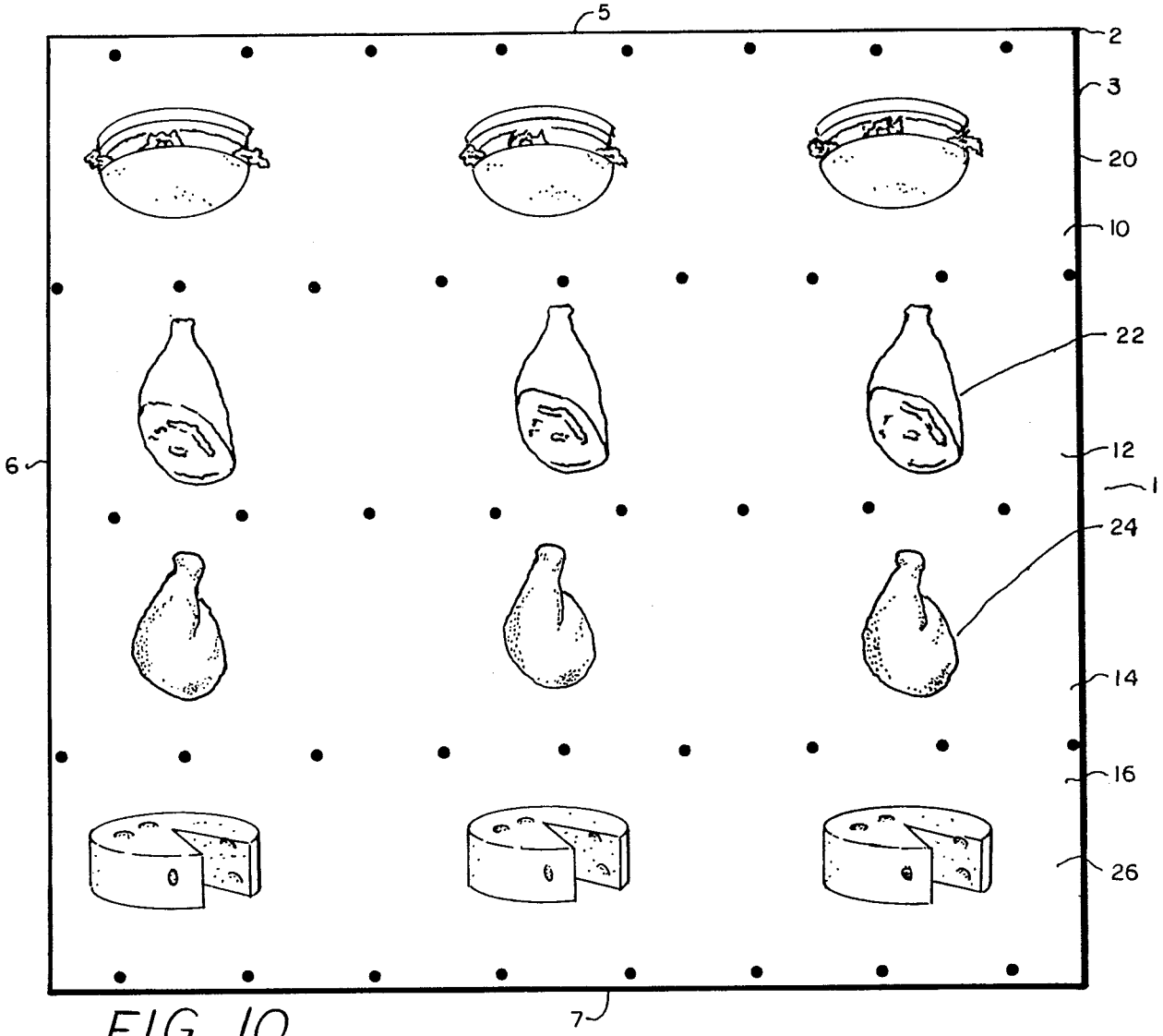
FIG. 10 is a top elevational view of the wrapping sheet of the present invention, showing drawings as product identifiers in the regions of the sheet.

While the indicia on wrapping sheet 1 has been shown as words, pictures, drawings, color differences, or any other product-differentiation indicia may be employed for the regions, such as the drawings illustrated in FIG. 10.

From the above, it is thus clear that the present invention provides a wrapping sheet material which is usable for wrapping multiple products and allowing clear identification of which of the multiple products contained in the package, without the need for external product identification means or registered wrapping sheets.

While the invention has been described with reference to certain specific embodiments thereof, it is not intended to be so limited thereby, except as set forth in the accompanying claims.

We claim:

1. A wrapping sheet suitable for use in wrapping multiple products while permitting identification of the product contained in said wrapping sheet, said wrapping sheet being generally rectangular or square and having first and second end edges and first and second side edges, and said wrapping sheet having first and second indicia bearing surfaces, said first indicia bearing surface comprising first, second, third and fourth generally longitudinally parallel regions, said first region of said first surface bearing indicia for a first product, said indicia of said first region of said first surface being oriented generally longitudinally to said first region of said first surface, said second region of said first surface bearing indicia for a second product, said indicia of said second region of said first surface being oriented generally crosswise to said second region of said first surface and facing said first end edge, said third region of said first surface bearing indicia for a third product, said indicia of said third region of said first surface being oriented generally crosswise to said third region of said first surface and facing said second end edge, said fourth region of said first surface bearing indicia for a fourth product, said indicia of said fourth region of said first surface being oriented generally longitudinally to said fourth region of said first surface, and said second indicia bearing surface comprising first, second, third and fourth generally longitudinally parallel regions, said first region of said second surface bearing indicia for said fourth product, said indicia of said first region of said second surface being oriented generally longitudinally to said first region of said second surface, said second region of said second surface bearing indicia for said second product, said indicia of said second region of said second surface being oriented generally crosswise to said second region of said second surface and facing said second end edge, said third region of said second surface bearing indicia for said third product, said indicia of said third region of said second surface being oriented generally crosswise to said third region of said second surface and facing said first end edge, said fourth region of said second surface bearing indicia for said first product, said indicia of said fourth region of said second surface being oriented generally longitudinally to said fourth region of said second surface.

2. The wrapping sheet of claim 1 wherein said indicia of said first region of said first surface and said indicia of said first region of said second surface face said first side edge.

3. The wrapping sheet of claim 2 wherein said indicia of said fourth region of said first surface and said indicia of said fourth region of said second surface face said second side edge.

4. The wrapping sheet of claim 1 wherein said indicia of said regions comprise words.

5. The wrapping sheet of claim 1 wherein indicia of said regions comprise drawings.

6. The wrapping sheet of claim 1 wherein said wrapping sheet is formed from aluminum foil.

7. The wrapping sheet of claim 1 wherein said wrapping sheet is formed from paper.

8. The wrapping sheet of claim 1 wherein said wrapping sheet is formed from an aluminum foil-paper laminate.

9. The wrapping sheet of claim 1 wherein said second and said third regions of said first surface and said second and said third regions of said second surface partially overlap.

10. The wrapping sheet of claim 1 wherein said second and said third regions of said first surface and said second and said third regions of said second surface completely overlap.

* * * * *